US006173138B1

(12) United States Patent
Koyama

(10) Patent No.: US 6,173,138 B1
(45) **Date of Patent: *Jan. 9, 2001**

(54) DEVELOPING APPARATUS AND IMAGE FORMING APPARATUS

(75) Inventor: Shoichi Koyama, Susono (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/288,024

(22) Filed: Apr. 8, 1999

(30) Foreign Application Priority Data

Apr. 8, 1998 (JP) ..... 10-111328

(51) Int. Cl.[7] ..... G03G 15/08
(52) U.S. Cl. ..... 399/103; 399/227; 399/285
(58) Field of Search ..... 399/98, 99, 102, 399/103, 223, 226, 227, 105, 234, 235, 53, 54, 55, 104, 222; 222/DIG. 1, 167; 361/212, 214

(56) References Cited

U.S. PATENT DOCUMENTS 4,697,914 * 10/1987 Hauser ..... 399/104
4,947,211 * 8/1990 Ono et al. ..... 399/105
5,172,165 * 12/1992 Hatakeyama et al. ..... 399/103
5,592,265 * 1/1997 Sakuraba et al. ..... 399/285
5,761,576 * 6/1998 Sugihara et al. ..... 399/227 X

FOREIGN PATENT DOCUMENTS 3-194582 * 8/1991 (JP) .

* cited by examiner

*Primary Examiner*—Sophia S. Chen
(74) *Attorney, Agent, or Firm*—Fitzpatrick, Cella, Harper & Scinto

(57) ABSTRACT

A developing apparatus includes a developer carrying member, provided in an opening of a developer container, for carrying a developer to a developer position. A leakage preventing member is supplied with a voltage from a voltage source having the same polarity as a charging property of the developer to prevent leakage of the developer from a longitudinal end of the developer carrying member. The developing apparatus is movable between an operative position for development where the voltage is capable of being applied and an inoperative position where the voltage is incapable of being applied. A discharging device electrically discharges the leakage preventing means after a start of movement from the operative position toward the inoperative position and before returning to the operative position. A capacitor, electrically is connected to the leakage preventing member, for accumulating electric charge supplied from said voltage source.

24 Claims, 5 Drawing Sheets

DEVELOPING APPARATUS AND IMAGE FORMING APPARATUS

FIELD OF THE INVENTION AND RELATED ART

The present invention relates to a developing apparatus which uses developer to develop an electrostatic latent image formed on an image bearing member. It also relates to an image forming apparatus which comprises such a developing apparatus.

In an image forming operation, an electrostatic latent image is formed and borne on a latent image bearing member, and is developed into a visible image by a developing apparatus which uses developer. As for such a developing apparatus, a developing apparatus 103 illustrated in FIG. 7 is well known. In the developing apparatus 103, a developer bearing member 100 is rotated, bearing developer on its peripheral surface. In order to develop the latent image borne on the latent image bearing member, a compound voltage is applied to the developer bearing member 100 from an electrical power supply source 101 through contact terminals 102 and 102. As the compound voltage is applied to the developer bearing member 100, an alternating electric field is generated between the latent image bearing member (unillustrated) and the developer bearing member 100. As a result, the developer borne on the peripheral surface of the developer bearing member 100 is transferred onto the latent image borne on the latent image bearing member, developing the latent image into a visible image.

FIG. 7 is a schematic sectional view of the developing apparatus 103, and depicts the general structure of the developing apparatus 103.

In the developing apparatus 103 in operation, the contact terminals 102 and 102 are placed in contact with each other to allow the compound voltage composed of AC and DC voltages, to be applied to the developer bearing member 100 from the electrical power supply source 101. As a result, the latent image formed and borne on the latent image bearing member is turned into a visible image. After the development of the electrostatic latent image, the contact terminals 102 and 102 are separated from each other, preventing the compound voltage from being applied to the developer bearing member from the electrical power supply source 101.

In recent years, a great number of innovative image formation technologies have been developed in terms of detail or resolution. Consequently, developer particle size has been made smaller and smaller, and also, developer particle shape has been made more and more sphere-like. This, however, created a problem called "developer blowout," that is, a problem that developer leaks from the developing apparatus. This problem occurs for the following reason. That is, developer particles with an extremely small size are difficult to triboelectrically charge. As a result, triboelectrically insufficiently charged developer particles tend to leak through the gap between the surface of the developer bearing member and the frame of the developing apparatus, at the longitudinal ends of the developer bearing member. Thus, prevention of the so-called "developer blowout" has long been desired.

Thus, in recent years, developing apparatuses such as a developing apparatus 203, illustrated in FIG. 8, which are designed to prevent the "developer blowout," have been proposed, and some of them have been put to practical usage. In these developing apparatuses, a leak prevention member 200 in the form of a roller is placed in contact with, or extremely close to, the developer bearing member, at each longitudinal end portion of the developer bearing member. More specifically, the peripheral surface of the leak prevention member 200 is placed in contact with, or extremely close to, the peripheral surface of the developer bearing member, to prevent the "developer blowout." In addition, a voltage with the same polarity as the polarity of the triboelectrically charged developer is applied to each leak prevention member 200 with the use of a condenser 201 as a voltage application member, and also, a voltage with the same polarity as the normal polarity to which the developer is charged is applied to the developer bearing member 100 through a diode 202 to prevent the developer from being adhered to the leak prevention members 200 and 200.

FIG. 8 is a schematic drawing which depicts the general structure of the developing apparatus 203.

Generally, the developing apparatus 203 is designed to take two distinctive positions, that is, a developmental position at which it develops a latent image and a nondevelopmental position to which it is retracted when it does not develop a latent image. As the developing apparatus is moved from the developmental position to the nondevelopmental position at the end of each latent image developing process, the contact terminals 102 and 102, which are in contact with each other when the developing apparatus 203 is at the developmental position, become separated from each other, and therefore, the contact terminal 102 on the developing apparatus main assembly side (position Y in the drawing) becomes a floating terminal. As a result, the potential level of this contact terminal becomes the same as that of the condenser 202. Therefore, if the electrical charge remaining in the condenser 202 does not sufficiently attenuate by the time the contact terminals 102 and 102 become separated from each other, sparks are created between the contact terminal 102 on the developing apparatus main assembly side (position Y in FIG. 8) and the contact terminal 102 on the image forming apparatus main assembly side, by the electrical charge remaining in the contact terminal 102 on the Y side immediately before the two contact terminals 102 come in contact with each other as the developing apparatus 203 is moved from the nondevelopmental position to the developmental position for the following latent image developing process. These sparks carbonize the contact terminal 102 on the image forming apparatus main assembly side, causing the image forming apparatus to malfunction. This has been one of the essential problems from which the developing apparatus 203 suffers.

SUMMARY OF THE INVENTION

The primary object of the present invention is to prevent developer from leaking from a developing apparatus, adjacent to the longitudinal end portions of the developer bearing member of the developing apparatus, and also to remove the residual electrical charge from the leak prevention member of the developing apparatus after each developing operation, so that it becomes possible to provide a leak free developing apparatus and a leak free image forming apparatus.

Another object of the present invention is to provide a developing apparatus and an image forming apparatus which reduce the residual electrical charge in the developing apparatus when voltage is not applied to the developing apparatus by an electrical power source.

Another object of the present invention is to provide a developing apparatus and an image forming apparatus which do not generate sparks by electrical discharge when the developing apparatus is moved back to the developmental position after it is moved from the developmental position to the nondevelopmental position.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, preferred embodiments of the present invention will be described with reference to the appended drawings.

Embodiment 1

First, referring to FIGS. 1 through 4, the first embodiment of the present invention will be described.

Figure 1:
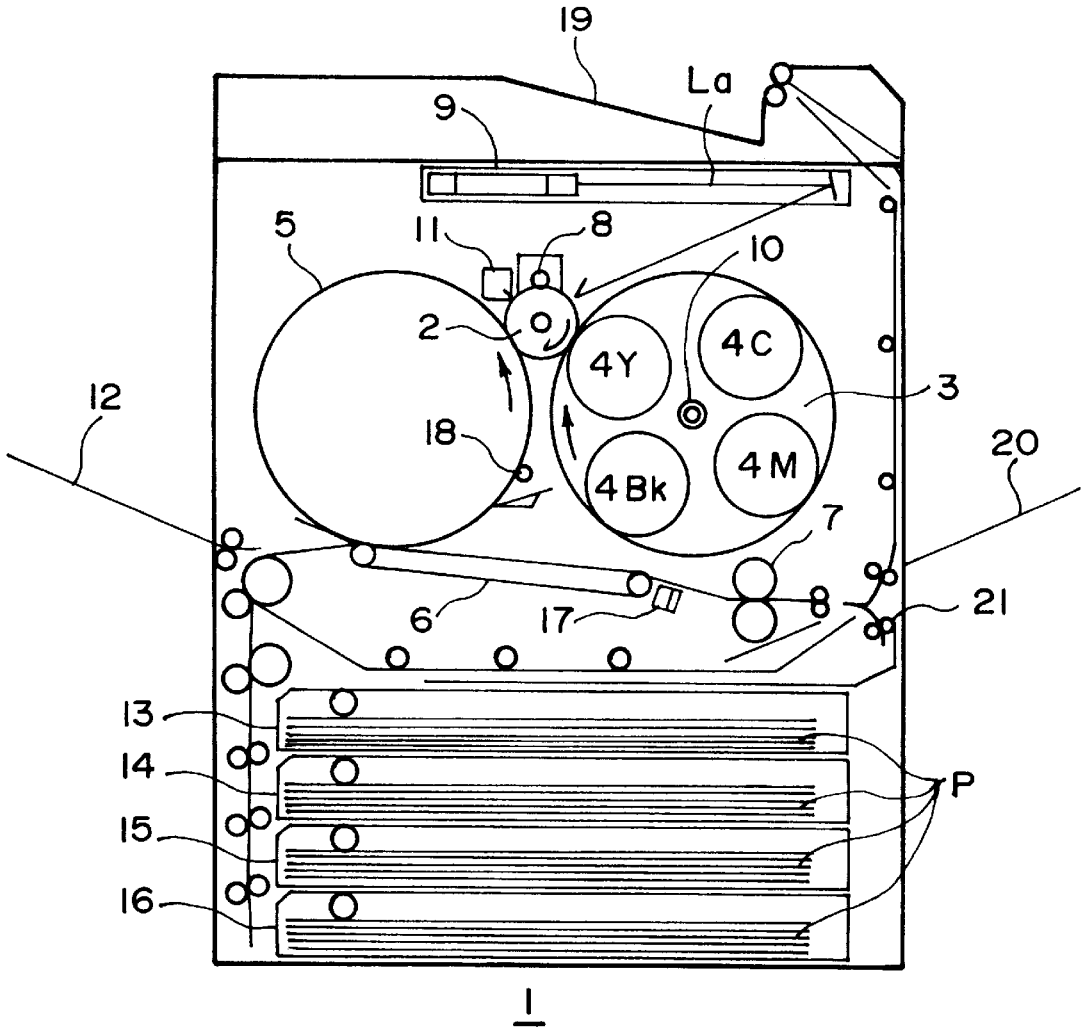
FIG. 1 is a schematic sectional view of an image forming apparatus which comprises the first embodiment of the present invention in the form of a developing apparatus, and depicts the general structure of the image forming apparatus.

FIG. 1 is a schematic sectional view of a color laser beam printer 1 (hereinafter, "printer 1") as an image forming apparatus in accordance with the present invention, and depicts the general structure of the printer 1. The printer 1 is such an image forming apparatus that forms an image, based on image formation data supplied from an external data source such as a host computer or the like, and transfers the formed image onto a piece of recording medium P.

Referring to FIG. 1, the printer 1 comprises an image bearing member 2 (hereinafter, "photosensitive drum 2"), a development rotary 3, a plurality of developing apparatuses 4Y, 4C, 4M, and 4B*k*, an intermediary image bearing member 5, a transfer/conveyer belt 6, and a fixing apparatus 7, and the like. The image bearing member 2 is in the form of a drum and is rotatable. The development rotary 3 removably supports the developing apparatuses 4Y, 4C, 4M, and 4B*k*, each of which holds a developer different in color from the developers in other developing apparatuses. The intermediary image bearing member 5 is also in the form of a roller and is rotatable. The visible images of different colors, which are formed and borne on the peripheral surface of the photosensitive drum, are temporarily borne in layers on the peripheral surface of the intermediary image bearing member 5. The transfer/conveyer belt 6 transfers the visible images temporarily borne in layers on the peripheral surface of the intermediary image bearing member 5, onto a sheet of recording medium P, and conveys the recording medium P with an unfixed image to the fixing apparatus 7. The fixing apparatus 7 fixes the unfixed image on the recording medium P to the recording medium P.

Next, referring to FIG. 1, the image formation process carried out by the printer 1 will be described in general terms.

First, the peripheral surface of the photosensitive member is uniformly charged by a primary charging device 8 (for example, to a potential level of −600 V). The uniformly charged peripheral surface of the photosensitive drum is exposed to a laser beam La intermittently projected from a laser unit 9 in response to the image formation data for a yellow color image, for example. As a result an electrostatic latent image correspondent to the image formation data for a yellow color image (hereinafter, electrostatic latent images correspondent to yellow, cyan, magenta, and black colors are called a latent yellow image, a latent cyan image, a latent magenta image, and a latent black image, correspondingly) is formed and borne on the peripheral surface of the photosensitive member.

The developing apparatuses 4Y, 4C, 4M, and 4B*k* hold yellow, cyan, magenta, and black color developers, correspondingly, and are removably supported by a development rotary 3 rotatively supported by an axle 10 with which the printer main assembly is provided. In order to visualize each of the latent images of different color, the developing apparatus correspondent to a latent image to be visualized is moved, by rotating the development rotary 3, to the developmental position at which the latent image is to be visualized. In FIG. 1, the developing apparatus 4Y is at the developmental position.

More specifically, in order to visualize the latent yellow image, the developing apparatus 4Y is selected from among the four developing apparatuses 4Y, 4C, 4M, and 4B*k*, and is moved to the aforementioned developmental position by rotating the development rotary 3. Then, at this position, the latent image is visualized into a yellow color image. The image forming apparatus and the developing apparatus 4Y, 4C, 4M, and 4B*k* are structured so that each developing apparatus can be installed into, or removed from, the image forming apparatus main assembly, independently from each other.

The visible yellow image, which has been formed and borne on the peripheral surface of the photosensitive drum by the developing apparatus 4Y, is transferred onto the peripheral surface of the intermediary transfer member to which such voltage that has polarity opposite to the polarity of the visible yellow image (a positive voltage of +200 V, for example) is being applied, and the transferred visible yellow image is temporarily borne there. Meanwhile, the substances remaining on the peripheral surface of the photosensitive drum are removed by a cleaner 11 to prepare the surface for the following image formation, that is, the formation of a latent cyan image.

Next, prior to the formation of the latent cyan image, the peripheral surface of the photosensitive drum is charged by the primary charging device 8, and is exposed to a laser beam La modulated with the cyan image formation data among the image formation data supplied from the aforementioned external image formation data source. As a result, a latent cyan image is formed and borne on the peripheral surface of the photosensitive member.

Then, the latent cyan image is visualized by the developing apparatus 4C having been moved to the developmental position by the rotation of the development rotary 3. The cyan image visualized by the developing apparatus 4C and borne on the peripheral surface of the photosensitive member is transferred onto the intermediary transfer member to which voltage with the polarity opposite to the polarity of the cyan image is being applied. More specifically, the cyan image is overlaid onto the yellow image borne on the peripheral surface of the intermediary transfer member, in alignment with the yellow image. Then, the substances remaining on the peripheral surface of the photosensitive member are removed by the cleaner 11 to prepare for the formation of the latent image correspondent to the following color, that is, magenta color.

Then, the sequence for forming the latent images correspondent to magenta and black colors and overlaying the magenta and black images onto the peripheral surface of the intermediary transfer member is carried out. As a result, an image (hereinafter, "color image") which reflects the image formation data supplied by the external image formation data source is created and borne on the peripheral surface of the intermediary transfer member.

Next, the peripheral surface of the intermediary transfer member 5 is placed in contact with the surface of a transfer/conveyer belt 6, and high voltage with the polarity opposite to the polarity of the color image is applied to the transfer/conveyer belt 6 (for example, when the polarity of the color image is negative, a voltage of +2 V is applied). Meanwhile, a sheet of recording medium P is fed out of a tray 12 attached to the side wall of the printer main assembly, or is fed out of cassette 13, 14, 15, or 16, and reaches the interface, or the transfer station, between the intermediary transfer member 5 and the transfer/conveyer belt 6. As the recording medium P is passed through the interface, the color image on the intermediary transfer member 5 is transferred onto the recording medium P. At this point, the color image has not been fixed to the recording medium P.

After the color image transfer, the residue on the peripheral surface of the intermediary transfer member is removed by a cleaning roller 18, which is placed in contact with the peripheral surface of the intermediary transfer member after the color image transfer, and to which voltage with the polarity opposite to the polarity of the color image being applied. As a result, the intermediary transfer member becomes prepared to bear the following color image.

The recording medium P which is bearing the unfixed color image is conveyed from the transfer station to the fixing apparatus 7 by the transfer/conveyer belt 6. While the recording medium P is conveyed to the fixing apparatus 7, the electrical charge (charge with the polarity opposite to the polarity of the unfixed color image) accumulated in the recording medium P is removed by a charge removal needle 17 to which voltage with the same polarity as the polarity of the unfixed color image is being applied (for example, when the polarity of the unfixed color image is negative, −1 kV is applied), until the trailing end of the recording medium P comes out of the transfer station.

In other words, the application of the voltage to the charge removal needle 17 is interrupted as the trailing end of the recording medium P, onto which the color image is being transferred, comes out of the transfer station. The intermediary transfer member 4 and the transfer/conveyer belt 6 are separated from each other as the color image transfer ends.

Next, the recording medium P which is bearing the unfixed color image is put through the fixing apparatus 7, in which the unfixed image is fixed to the recording medium P. After the fixation of the color image to the recording medium P, the recording medium P is discharged into a delivery tray 19 located at the top of the printer main assembly, or into a delivery tray 20 attached to the side wall of the printer main assembly, ending a single cycle of a color image formation sequence. When necessary to form an image on both sides of the recording medium P, the recording medium P is turned over by a switchback roller 21 or the like after the fixation of the first image onto one side of the recording medium P. Then, the recording medium P is discharged into the delivery tray 19 or 20 after the second image is formed on the other side of the recording medium P through the above described image formation sequence.

Next, the developing apparatus 4Y will be described with reference to FIG. 2, which is a schematic perspective view of the developing apparatus 4Y, and depicts the general structure of the developing apparatus 4Y. Since the general structures of the developing apparatuses 4C, 4M, and 4B*k* are the same as that of the developing apparatus 4Y, their descriptions will be omitted here.

The developing apparatus 4Y comprises a development sleeve 4YS and a pair of developer leak prevention members 27 in the form of a roller. The development sleeve 4YS is a rotative developer bearing member, and is in the form of a cylindrical roller. The developer leak prevention members 27 in the form of a roller (hereinafter, developer leak prevention roller) are placed in contact with the development sleeve 4YS to prevent developer from leaking.

Figure 3:
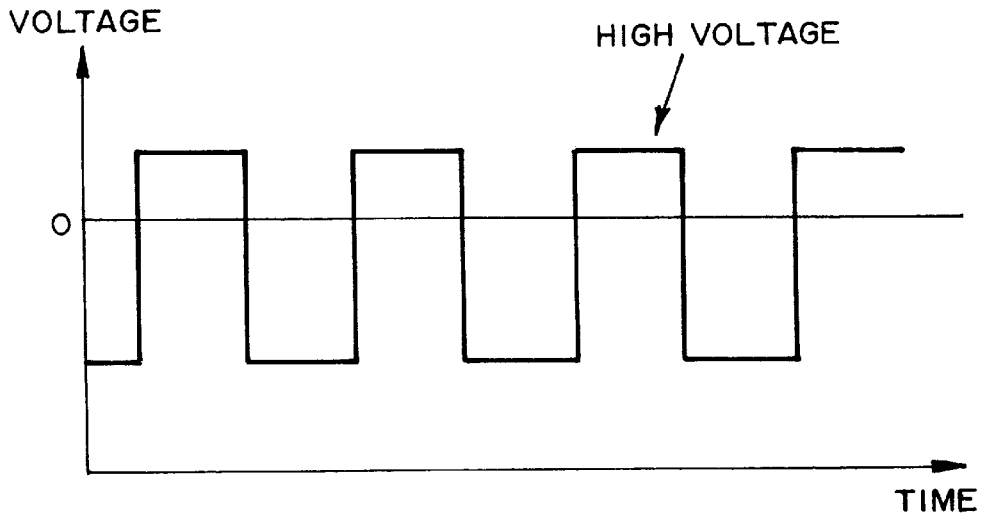
FIG. 3 is a graph which shows the approximate waveform of the compound voltage applied to the development sleeve illustrated in FIG. 2.

The development sleeve 4YS is moved by the rotation of the development rotary 10 to the developmental position, at which the peripheral surface of the development sleeve 4YS directly faces the peripheral surface of the latent image bearing member 2, with the presence of a predetermined gap between the two peripheral surfaces. In a developing operation, the compound voltage composed of AC voltage with a rectangular wave-form, and DC voltage, is applied to the development sleeve 4YS from an electrical power supply source 22 through contact terminals 23 and 23, as illustrated in FIG. 3. The rotational direction of the developing apparatus 4YS at the developmental position is opposite to the rotational direction of the photosensitive member.

To the developer leak prevention rollers 27 and 27, voltage (negative voltage) with the same polarity as the polarity of the triboelectrically charged developer is applied from a condenser 24 (electrostatic capacity=330 $\mu$F), that is, a voltage supplying member which accumulates the electrical charge supplied by the electrical power supply source 22.

FIG. 3 is a graph which depicts the approximate wave-form of the compound voltage applied to the development sleeve 4YS. The power source 22 is shared by the developing apparatuses 4Y, 4C, 4M, and 4B*k*. As each developing apparatus is moved to the developmental position, the contact terminal 23 on the developing apparatus main assembly side comes in contact with the contact terminal 23 on the image forming apparatus main assembly side, that is, the contact terminal 23 on the power source 22 side. On the contrary, as the developing apparatus is moved from the developmental position to the nondevelopmental position by the rotation of the development rotary 5, the contact terminal 23 on the developing apparatus side is separated from the contact terminal 23 on the power source 22 side, preventing electrical power from being supplied to the developing apparatus.

As the compound voltage is applied to the development sleeve 4YS from the electrical power supply source 22, an alternating electrical field is generated between the latent image bearing member 2 and the development sleeve 4YS. The electric field affects the developer, which has been triboelectrically charged, causing it to move away from the peripheral surface of the development sleeve and adhere to the selected areas of the peripheral surface of the latent image bearing member. As a result, the latent image, which has been formed and borne on the latent image bearing member, is visualized.

The pair of developer leak prevention rollers 27 is placed in contact with, or extremely close to, the peripheral surface of the development sleeve, at the longitudinal axial end portions of the development sleeve, one for one, to prevent the developer from being blown out from the developing apparatus. Further, a voltage with the same polarity as the polarity of the triboelectrically charged developer is applied to each of the developer leak prevention members 27 from the condenser 24, to prevent the developer from adhering to the developer leak prevention members 27 and 27. The developer leak prevention members 27 and 27 are disposed at the opening portion of the developing apparatus shell, on the side where the peripheral surface of the development sleeve moves outward of the developing apparatus.

In this embodiment, the polarity of the developer is negative, and therefore, a voltage with the negative polarity, that is, the same polarity as the polarity to which the developer is charged, is applied to each of the developer leak prevention rollers 27 and 27 from the condenser 24. Therefore, the developer or the like, which has been negatively charged, is prevented from adhering to the developer leak prevention rollers 27 and 27.

Figure 4:
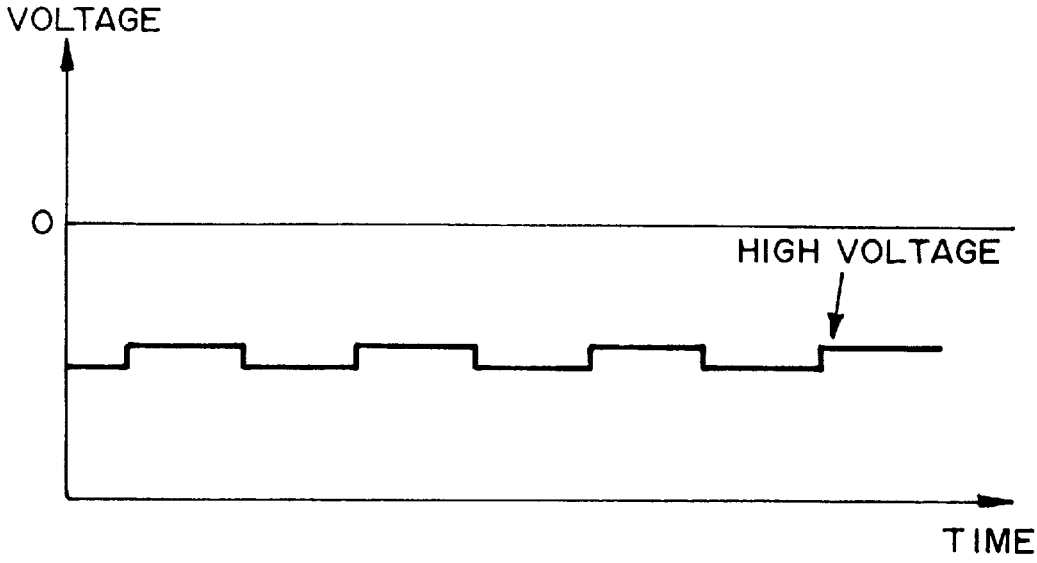
FIG. 4 is a graph which shows the approximate waveform of the voltage applied to the developer leak prevention members (rollers) illustrated in FIG. 2.

FIG. 4 is a graph which depicts the approximate waveform of the voltage applied to each of the developer leak prevention rollers 27 and 27 In comparison to the voltage waveform illustrated in FIG. 3, the voltage waveform illustrated in FIG. 4 is distinctive in that the voltage on the positive side has been cut off by the rectifying function of a diode 25, and negative voltage is overlaid to the negative side by the function of a condenser 24.

The condenser 24 is grounded in parallel to a resistor 26 as a residual charge removal member (resistance=500 MΩ), one end of which is grounded.

Therefore, the residual charge in the condenser 24, that is, the residual charge in each of the developer leak prevention rollers 27 and 27, is removed after each developing operation.

More specifically, in the case of this embodiment, at the end of the visualization of the latent image correspondent to, for example, yellow color, the developing apparatus 4YS is retracted from the aforementioned developmental position, causing thereby the contact terminals 23 and 23 to be separated from each other. As a result, a certain amount of electrical charge is left in the condenser 24 and the developer leak prevention rollers 27 and 27. However, this residual electrical charge in the condenser 24 and the developer leak prevention rollers 27 and 27 is removed by the resistor 26. The time it takes to remove the residual electrical charge is determined by the value of the time constant which is determined by the product of the capacity of the condenser 24 and the resistance of the resistor 26.

Figure 2:
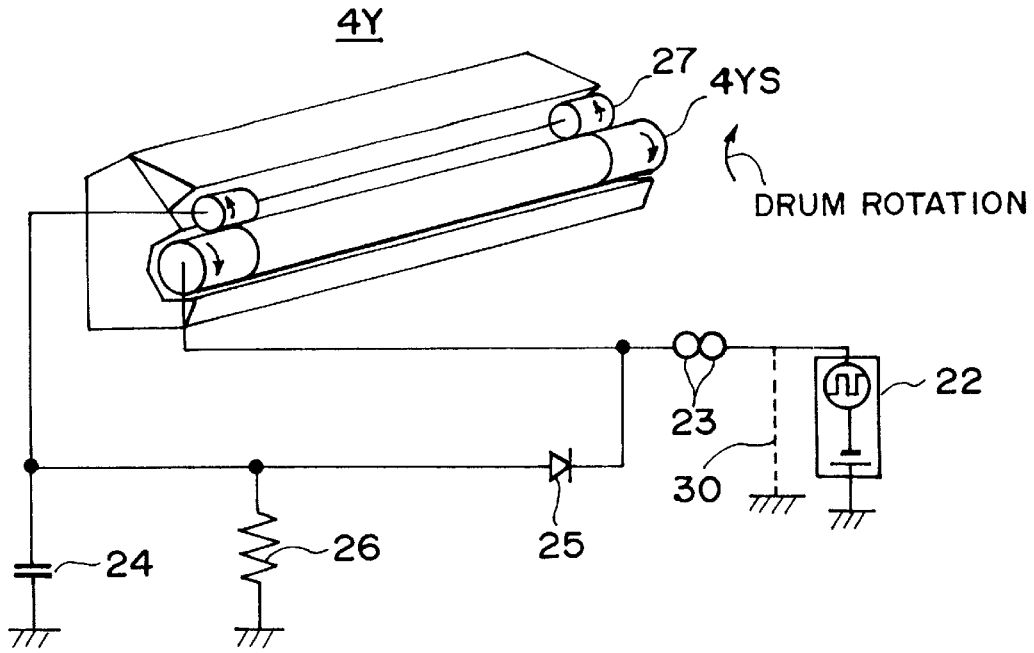
FIG. 2 is a schematic perspective view of the developing apparatus illustrated in FIG. 1, and depicts the general structure of the developing apparatus.

Immediately before a developing apparatus begins to be moved from the developmental position to the nondevelopmental position, the contact terminal 23 on the image forming apparatus main assembly side may be either connected to the power source 22 as illustrated in FIG. 2, or grounded as illustrated by the dotted line 30 in FIG. 2. In the latter case, the duration of the time from the time when the state of development bias is switched from the ON-state to the Off-state (switching from the power source 22 to the ground 30), to the time when the developing apparatus begins to be moved, is approximately 50–100 psec.

When the developing apparatus is returned from the nondevelopmental position to the developmental position, the contact terminal 23 on the image forming apparatus main assembly is desired to be in the state of being grounded through the line 30. The state of the power source 22 should be switched from the ON-state to the Off-state after the contact terminal 23 on the developing apparatus side becomes connected to the contact terminal 23 on the image forming apparatus main assembly side, as the developing apparatus is moved back to the developmental position.

In the case of this embodiment, the minimum time necessary for the developing apparatus for any given color to move from the developmental position to the nondevelopmental position, and then return to the developmental position, is approximately 15 seconds when a full-color image is continuously formed on a plurality of transfer media, one image per medium. Therefore, it is desired that the capacity of the condenser 24 and the resistance value of the resistor 26 are set so that the time necessary to remove the residual electrical charge in the condenser 24 is shorter than the aforementioned minimum time.

As described above, in the case of this embodiment, the condenser 24 applies voltage with the same polarity as the polarity of the triboelectrically charged developer to each of the developer leak prevention rollers 27, to prevent the aforementioned adhesion of the developer to the developer leak prevention rollers 27 and 27. Further, the resistor 26 sufficiently removes the electrical charge, which remains in the developer leak prevention rollers 27 and 27 at the end of the developing operation of each developing apparatus, by the time the developing operation by the following developing apparatus begins. Therefore, not only can the developer blowout and the developer adhesion to the developer leak prevention rollers 27 and 27 be prevented as they could by the conventional design, but also it is assured that the spark is not generated between the contact terminals 23 and 23 by electrical discharge when the developing operation by the following developing apparatus is started.

The numerical values in the preceding description of this embodiment are used for the sake of convenience, and obviously, those values may be changed within the scope of this embodiment.

Embodiment 2

Next, referring to FIG. 5, the second embodiment of the present invention in the form of a developing apparatus will be described. The general structure of an image forming apparatus, which comprises this developing apparatus, is the same as that of the image forming apparatus which comprises the first embodiment of the present invention in the form of a developing apparatus, and is illustrated in FIG. 1. Therefore, the description of the structure of the image forming apparatus will be omitted here.

Figure 5:
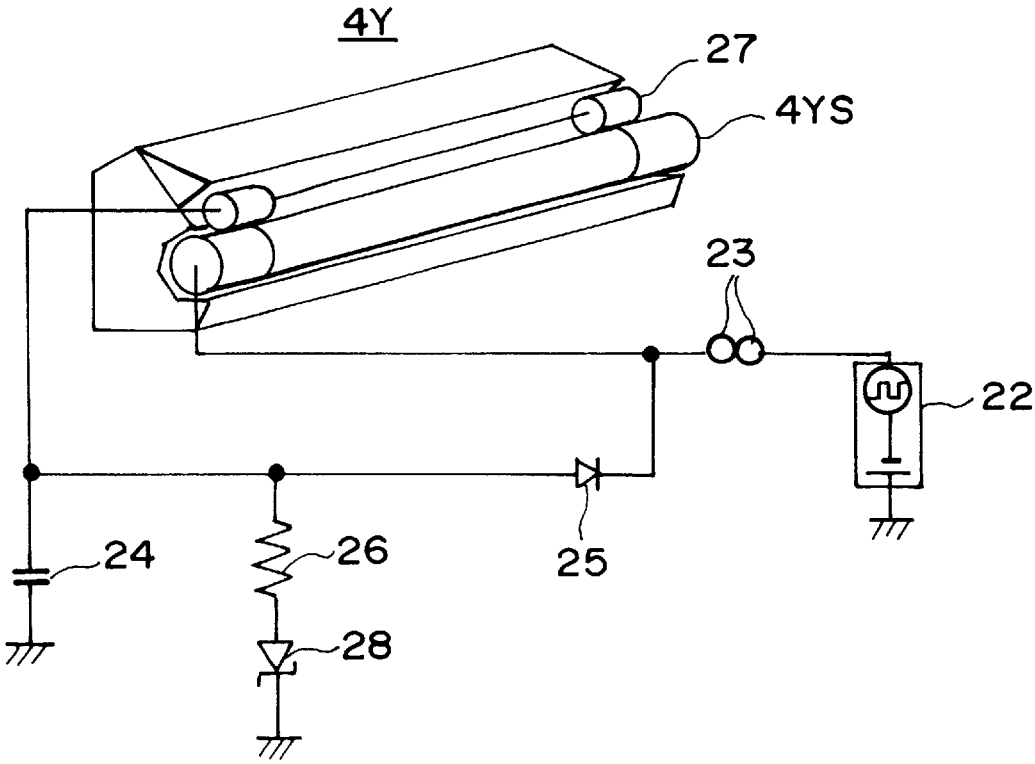
FIG. 5 is a schematic perspective view of the second embodiment of the present invention in the form of a developing apparatus, and depicts the general structure of the developing apparatus.

FIG. 5 is a schematic perspective view of the second embodiment of the present invention in the form of a developing apparatus 4Y, and depicts the general structure of the developing apparatus 4Y. The components, positions, and the like, which are common with those in the first embodiment, are designated with the same referential characters as those in FIG. 1, and their description will be omitted.

In the case of this embodiment, one end of a resistor 27 is grounded through a Zener diode 28. The amount by which the electrical charge, which is left in a condenser 24 and developer leak prevention roller 27 and 27, is removed is controlled by a resistor 26.

In other words, in the case of this embodiment, the major portion of the electrical charge which is left in the condenser 24 and developer leak prevention rollers 27 and 27 as contact terminals 23 and 23 are separated from each other at the end of a developing operation, is removed through the resistor 26 and Zener diode 28. However, because of the characteristic of the Zener diode 28, the rest of the residual electrical charge remains in the developer leak prevention rollers 27 and 27, and keeps on generating the force which prevents the developer from adhering to the developer leak prevention rollers 27 and 27.

Therefore, in the case of this embodiment, not only are the same effects as those provided by the first embodiment obtained, but also there is another benefit that the force which prevents developer from adhering to the developer leak prevention rollers 27 and 27 is maintained even during the period from the end of a developing operation to the beginning of the following developing operation.

Embodiment 3

Next, referring to FIG. 6, the third embodiment of the present invention in the form of a developing apparatus will be described. The general structure of the image forming apparatus which comprises this third embodiment of the present invention in the form of a developing apparatus is the same as the general structure illustrated in FIG. 1 and described in the description of the first embodiment. Therefore, its description will be omitted here.

Figure 6:
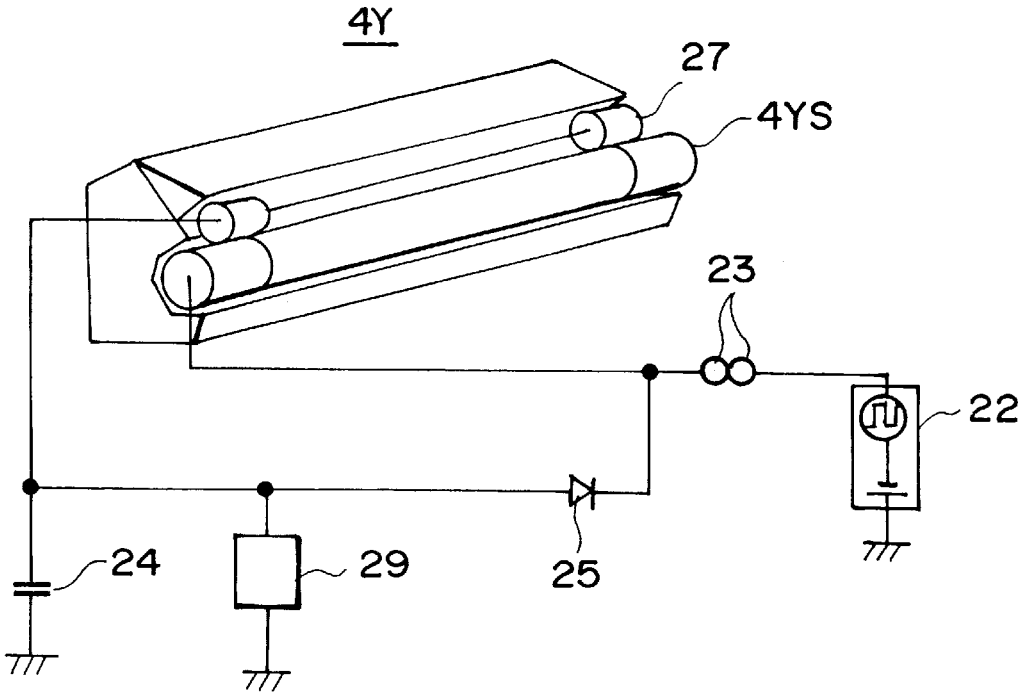
FIG. 6 is a schematic perspective view of the third embodiment of the present invention in the form of a developing apparatus, and depicts the general structure of the developing apparatus.
Figure 7:
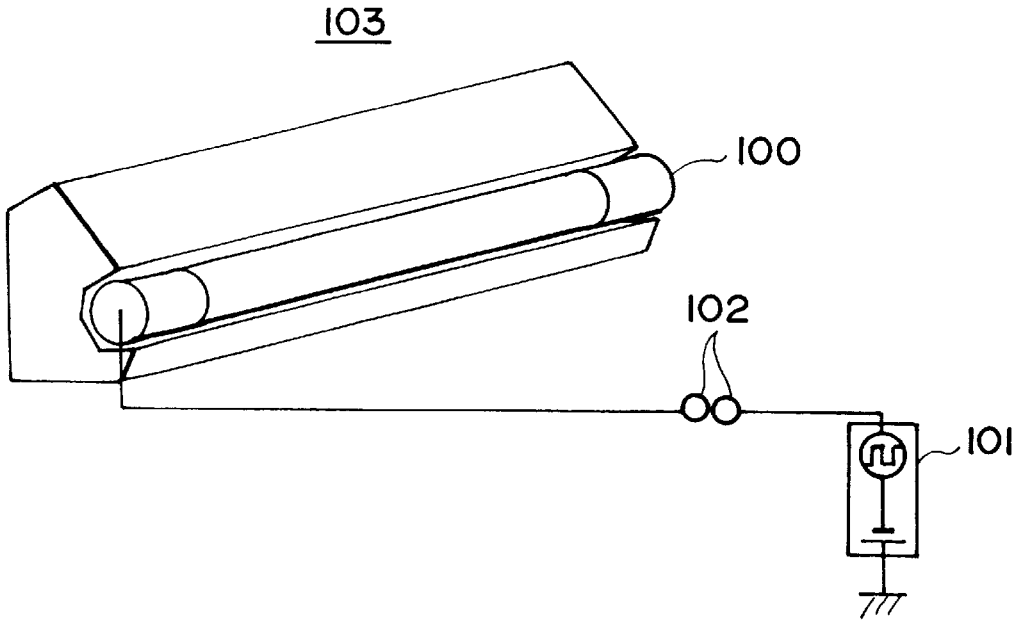
FIG. 7 PRIOR ART
FIG. 7 is a schematic perspective view of one of the typical conventional developing apparatuses, and depicts the general structure of the conventional developing apparatus.
Figure 8:
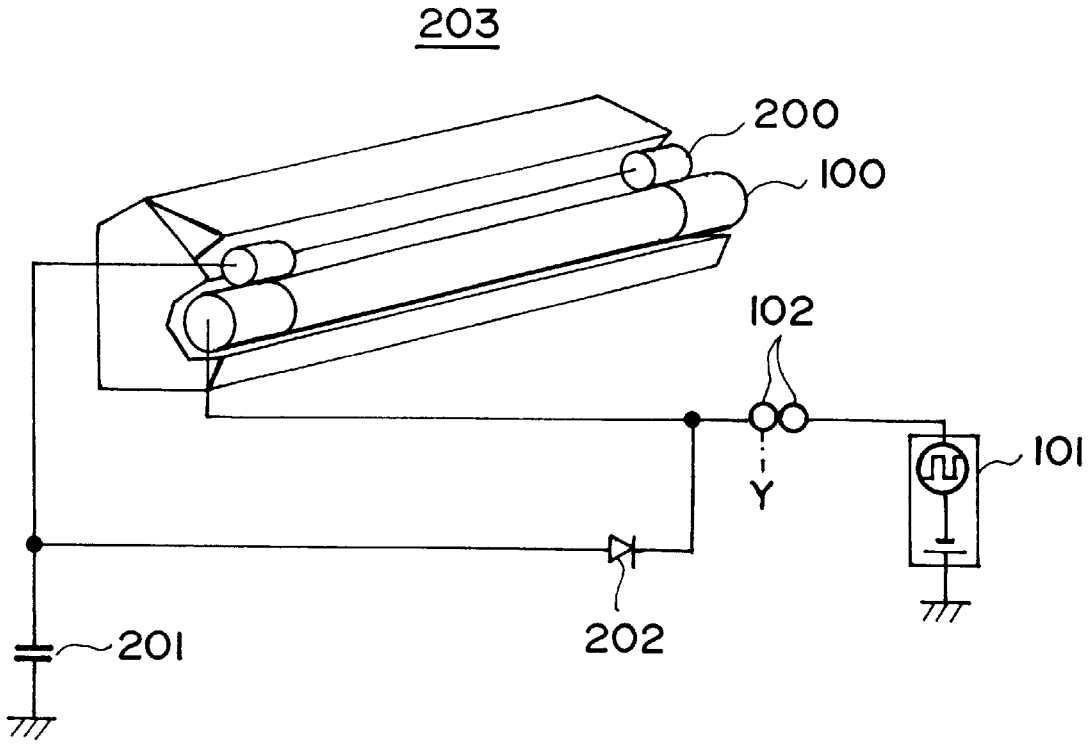
FIG. 8 PRIOR ART
FIG. 8 is a schematic perspective view of another of the typical conventional developing apparatuses, and depicts the general structure of the developing apparatus.

FIG. 6 is a schematic perspective view of the developing apparatus 4Y in accordance with the present invention, and depicts the general structure of the developing apparatus 4Y. The components, positions, and the like in the drawing, which are the same as those in FIG. 2, are designated with the same reference characters as those in FIG. 2 so that their descriptions can be omitted.

In the case of this embodiment. a compound resistor 29 constituted of a plurality of electrical elements is employed as the residual electrical charge removal member, and is connected in parallel with a condenser 24.

Therefore, in the case of this embodiment, not only are the same effects as those provided by the first embodiment obtained, but also the same effects as those provided by the second embodiment can be obtained by modifying the arrangement of the electrical elements which constitute the compound resistor 29.

In the preceding descriptions of the first to third embodiments of the present invention, a color laser beam printer was referred to as an example of an image forming apparatus compatible with the present invention. However, the same effects and benefits as those described in the descriptions of the first to third embodiments of the present invention can also be obtained when any of the first to third embodiments is employed in an image forming apparatus other than a color laser beam printer, for example, a copying machine, which is needless to say.

While the invention has been described with reference to the structures disclosed herein, it is not confined to the details set forth, and this application is intended to cover such modifications or changes as may come within the purposes of the improvements or the scope of the following claims.

What is claimed is:

1. A developer apparatus comprising:

a developer carrying member, provided in an opening of a developer container, for carrying a developer to a developing position;

a leakage preventing member being supplied with a voltage from a voltage source having the same polarity as a charging property of the developer to prevent leakage of the developer from a longitudinal end of said developer carrying member;

wherein said developing apparatus is movable between an operative position for development where said voltage is capable of being applied and an inoperative position where said voltage is incapable of being applied;

discharging means for electrically discharging said leakage preventing member after start of movement from said operative position toward said inoperative position and before returning to said operative position; and a capacitor, electrically connected to said leakage preventing member, for accumulating electric charge supplied from said voltage source.

2. An apparatus according to claim 1, wherein said discharging means is provided with a resistor electrically connected with said capacitor in parallel with said capacitor.

3. An apparatus according to claim 2, wherein said resistor is electrically grounded through a diode.

4. An image forming apparatus comprising:

an image bearing member;

a plurality of developing devices, having developers of different colors, for developing an electrostatic image formed on said image bearing member at a developing position;

each of said developing devices including:

a developer carrying member, provided in an opening of a developer container, for carrying a developer to a developing position;

at least one of said developing devices including, a leakage preventing member being supplied with a voltage from a voltage source having the same polarity as a charging property of the developer to prevent leakage of the developer from a longitudinal end of said developer carrying member;

wherein said developing device is movable between an operative position for development where said voltage is capable of being applied and an inoperative position where said voltage is incapable of being applied;

discharging means for electrically discharging said leakage preventing member after start of movement from said operative position toward said inoperative position and before returning to said operative position; and a capacitor, electrically connected to said leakage preventing member, for accumulating electric charge supplied from said voltage source.

5. An apparatus according to claim 4, wherein said discharging means is provided with a resistor electrically connected with said capacitor in parallel with said capacitor.

6. An apparatus according to claim 5, wherein said resistor is electrically grounded through a diode.

7. A developing apparatus usable for an image forming apparatus, comprising:

a developer carrying member, provided in an opening or a developer container, for carrying a developer to a developing position;

a leakage preventing member for preventing leakage of the developer from a longitudinal end of said developer charring member;

a first electric contact electrically contacted with said leakage preventing member, said first electric contact being contactable to a second electric contact provided in a main assembly of the image forming apparatus, wherein said first and second electric contacts are contacted to each other, said second electric contact being capable of being supplied with a voltage from a voltage source having the same polarity as a charging polarity of the developer from a voltage provided in the main assembly of the image forming apparatus; and discharging means for electrically discharging said leakage preventing member when said first and second contacts are not contacted to each other.

8. An apparatus according to claim 7, wherein said developing apparatus is movable between an operative position for development and an inoperative position, and wherein when said developing apparatus is in the operative position, said first and second electric contacts are contacted to each other, and when said developing apparatus is in said inoperative position, said first and second contacts are not contacted to each other.

9. An apparatus according to claim 7, wherein said developing apparatus is detachably mountable to the main assembly of the image forming apparatus.

10. An apparatus according to claim 7, further comprising a capacitor, electrically connected with said leakage preventing member and said first electric contact, for accumulating electric charge supplied from said voltage source.

11. An apparatus according to claim 10, wherein said discharging means is provided with a resistor electrically connected with said capacitor in parallel with said capacitor.

12. An apparatus according to claim 11, wherein said resistor is electrically grounded through a diode.

13. An apparatus according to claim 7, wherein said first electric contact is electrically connected with said developer carrying member.

14. A developing apparatus usable for an image forming apparatus, comprising:

a developer carrying member, provided in an opening of a developer container, for carrying a developer to a developing position;

a leakage preventing member leakage of the developer from a longitudinal end of said developer carrying member;

an electric circuit for supplying a voltage to said leakage preventing member from a voltage source provided in a main assembly of said image forming apparatus, the electric circuit being effective to change a voltage which has alternating polarities and which is supplied from said voltage source, to the same polarity as a charging polarity of the developer, wherein said electric circuit includes discharging means for electrically discharging said leakage preventing member when said electric circuit is not electrically connected with the voltage source.

15. An apparatus according to claim 14, wherein said developing apparatus is movable between an operative position for development and an inoperative position, wherein aid electric circuit is electrically connected with said voltage source when said developing apparatus is in said inoperative position.

16. An apparatus according to claim 15, wherein said electric circuit is electrically connected with a grounding contact of the main assembly of said image forming apparatus without electric connection with the voltage source, when said developing apparatus moves from said operative position to said inoperative position and when said developing apparatus moves said inoperative position to said operative position.

17. An apparatus according to claim 14, wherein said developing apparatus is detachably mountable to the main assembly of the image forming apparatus.

18. An apparatus according to claim 14, wherein said electric circuit includes a capacitor for accumulating electric charge supplied from said voltage source.

19. An apparatus according to claim 18, wherein said discharging means is provided with a resistor electrically connected with said capacitor in parallel with said capacitor.

20. An apparatus according to claim 19, wherein said resistor is electrically grounded through a diode.

21. An apparatus according to claim 14, wherein said developer carrying member is supplied with a voltage through a line branching from said electric circuit.

22. An apparatus according to claim 21, further comprising an electric contact electrically connectable with said voltage source, said electric contact being electrically connected with said electric circuit and with said developer carrying member.

23. An apparatus according to claim 14, wherein said electric circuit rectifies the voltage having the alternating polarities.

24. An apparatus according to claim 14, wherein main assembly of said image forming apparatus is provided with a contact which is electrically connectable with said voltage source, and said discharging means electrically discharges said leakage preventing member when said electric circuit is not electrically connected with said contact.

* * * * *

UNITED STATES PATENT AND TRADEMARK OFFICE

CERTIFICATE OF CORRECTION

PATENT NO. : 6,173,138 B1
DATED : January 9, 2001
INVENTOR(S) : Shoichi Koyama

It is certified that error appears in the above-identified patent and that said Letters Patent is hereby corrected as shown below:

Column 6,
Line 38, "wave-form," should read -- waveform, --.

Column 7,
Line 34, "27 and 27" should read -- 27 and 27. --.

Column 10,
Lines 5 and 38, "member;" should read -- member, --;
Line 63, "charring" should read -- carrying --; and
Line 65, "contacted with" should read -- connected to --.

Column 11,
Line 2, "wherein" should read -- wherein when --;
Line 5, "having the same polarity as a charging" should be deleted;
Line 6, "polarity of the developer from a voltage" should be deleted;
Line 39, "member" should read -- member for preventing --; and
Line 41, "member;" should read -- member; and --.

Column 12,
Line 8, "aid" should read -- said --; and
Line 42, "main" should read -- the main --.

Signed and Sealed this

Sixth Day of November, 2001

*Attest:*

Nicholas P. Godici

*Attesting Officer*

NICHOLAS P. GODICI
*Acting Director of the United States Patent and Trademark Office*